US009004673B2

(12) United States Patent
Hakamata et al.

(10) Patent No.: US 9,004,673 B2
(45) Date of Patent: Apr. 14, 2015

(54) CONVEYANCE CONTROLLER, PRINTING APPARATUS, METHOD OF CONVEYING PRINTING MEDIUM, AND PRINTING MEDIUM CONVEYANCE APPARATUS

(75) Inventors: Keisei Hakamata, Tokyo (JP); Hiroyuki Saito, Yokohama (JP); Takao Nakamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 722 days.

(21) Appl. No.: 13/297,701

(22) Filed: Nov. 16, 2011

(65) Prior Publication Data

US 2012/0148325 A1 Jun. 14, 2012

(30) Foreign Application Priority Data

Dec. 14, 2010 (JP) ..... 2010-278207

(51) Int. Cl.
*B41J 11/42* (2006.01)
*B41J 11/48* (2006.01)
*B41J 13/076* (2006.01)

(52) U.S. Cl.
CPC ..... *B41J 11/485* (2013.01); *B41J 13/076* (2013.01)

(58) Field of Classification Search
CPC ..... B41J 11/42; B41J 11/425
USPC ..... 347/5, 16, 84, 104, 105
See application file for complete search history.

(56) References Cited

U.S. PATENT DOCUMENTS

| | | | | |
|---|---|---|---|---|
| 6,065,830 | A | 5/2000 | Hiramatsu et al. | |
| 6,575,568 | B1 | 6/2003 | Hiramatsu et al. | |
| 6,824,234 | B2 | 11/2004 | Sugiyama et al. | |
| 7,158,259 | B2 | 1/2007 | Sugiyama et al. | |
| 7,517,074 | B2 * | 4/2009 | Hakamada et al. | 347/100 |
| 2008/0012216 | A1 * | 1/2008 | Tsukamoto et al. | 271/265.01 |
| 2009/0246396 | A1 * | 10/2009 | Nakazawa et al. | 427/428.18 |
| 2011/0222927 | A1 * | 9/2011 | Yamashina | 399/328 |
| 2011/0229178 | A1 * | 9/2011 | Ogawa et al. | 399/67 |
| 2012/0141174 | A1 * | 6/2012 | Kurita et al. | 399/329 |

FOREIGN PATENT DOCUMENTS

JP 5-238580 A 9/1993

* cited by examiner

*Primary Examiner* — David Banh
(74) *Attorney, Agent, or Firm* — Fitzpatrick, Cella, Harper & Scinto

(57) ABSTRACT

This invention includes an input operation unit which accepts the operation of selecting a first or a second printing medium and outputs information indicating the selected printing medium, a conveyance path, a conveyance mechanism which conveys the selected printing medium in the conveyance direction, and a control unit. The conveyance mechanism includes a main roller, a driven roller which presses the main roller through the selected printing medium, a rotation member having a cam shape, and an elastic member which deforms to change a pressing force in accordance with the rotational position of the rotation member. The control unit rotates the rotation member to the first rotational position when the first printing medium is selected, and rotates the rotation member to the second rotational position where the pressing force becomes smaller than that at the first rotational position when the second printing medium is selected.

15 Claims, 7 Drawing Sheets

CONVEYANCE CONTROLLER, PRINTING APPARATUS, METHOD OF CONVEYING PRINTING MEDIUM, AND PRINTING MEDIUM CONVEYANCE APPARATUS

BACKGROUND OF THE INVENTION

1. Field of the Invention

The present invention relates to a technique of conveying a printing medium whose surface is coated with a special liquid.

2. Description of the Related Art

Some printing apparatus which prints on a printing medium includes a conveyance mechanism for conveying a printing medium. This conveyance mechanism generally includes a conveyance roller and a driven roller which presses the conveyance roller through a printing medium. As the conveyance roller rotates, the driven roller rotates in a direction opposite to that of the conveyance roller to convey a printing medium in the conveyance direction.

Some printing apparatus having an arrangement like that described above uses a printing medium whose surface is coated with a special liquid which quickens the coagulation of the pigment component contained in ink. This liquid is mixed with a solvent and has a higher viscosity than water. For this reason, a mixture of the liquid and paper dust tends to be generated on the surface of a printing medium. This mixture sometimes adheres to the driven roller at the time of the conveyance of a printing medium. The mixture adhering to the driven roller is pressed and hardened by the conveyance roller as the driven roller directly presses the conveyance roller after the conveyance of the printing medium. As a result, for example, a printing medium may be contaminated or the conveyance performance may deteriorate.

Japanese Patent Laid-Open No. 5-238580 discloses a cleaning apparatus for solving the above problem. This cleaning apparatus causes a cleaning sheet for cleaning the conveyance roller provided on a paper conveyance path to pass the conveyance roller. This removes foreign substances adhering to the conveyance roller.

The cleaning apparatus disclosed in Japanese Patent Laid-Open No. 5-238580 requires the cumbersome operation of preparing a cleaning sheet and setting it in the apparatus in place of a printing medium.

SUMMARY OF THE INVENTION

The present invention provides a technique capable of easily reducing foreign substances adhering to a conveyance mechanism which conveys a printing medium.

According to a first aspect of the present invention there is provided a conveyance controller comprising an input operation unit configured to accept operation of selecting, as a printing medium, a first printing medium or a second printing medium obtained by coating a surface of the first printing medium with a liquid having a higher viscosity than water and output information indicating the selected printing medium, a conveyance path through which the selected printing medium passes, a conveyance mechanism provided on the conveyance path and configured to convey the selected printing medium in a conveyance direction, and a control unit connected to the input operation unit and the conveyance mechanism, wherein the conveyance mechanism includes a main roller, a driven roller which presses the main roller through the selected printing medium and rotates in a direction opposite to a rotating direction of the main roller upon rotation of the main roller, a rotation member having a cam shape, and an elastic member which deforms in conformity with the cam shape at the time of rotation of the rotation member to change a pressing force to press the driven roller against the main roller in accordance with a rotational position of the rotation member, and the control unit rotates the rotation member to a first rotational position when the selected printing medium indicated by the information is the first printing medium, and rotates the rotation member to a second rotational position where the pressing force becomes smaller than the pressing force at the first rotational position when the selected printing medium indicated by the information is the second printing medium.

According to a second aspect of the present invention there is provided a printing apparatus comprising: the above conveyance controller; and a printing unit placed above the conveyance path in the conveyance controller and configured to print on the selected printing medium.

According to a third aspect of the present invention there is provided a method for conveying a printing medium while nipping the printing medium by means of a main roller and a driven roller, the method comprising conveying the printing medium upon changing a nipping force as needed such that when a printing medium coated with no liquid is conveyed, the printing medium is nipped with a first nipping force, and when a printing medium coated with a liquid is conveyed, the printing medium is nipped with a second nipping force smaller than the first nipping force.

According to a fourth aspect of the present invention there is provided a printing medium conveyance apparatus comprising: a coating unit configured to selectively coat a printing medium with a liquid; a conveyance roller configured to convey the printing medium downstream of the coating unit in a conveyance direction; a driven roller configured to nip the printing medium in cooperation with the conveyance roller by a nipping force; a nipping force changing unit configured to change the nipping force by the conveyance roller and the driven roller; an acquisition unit configured to acquire information indicating whether the coating unit has coated the printing medium with a liquid; and a control unit configured to control the nipping force changing unit in accordance with information acquired by the acquisition unit to change a nipping force as needed such that when a printing medium coated with no liquid is conveyed, the printing medium is nipped with a first nipping force, and when a printing medium coated with a liquid is conveyed, the printing medium is nipped with a second nipping force smaller than the first nipping force.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
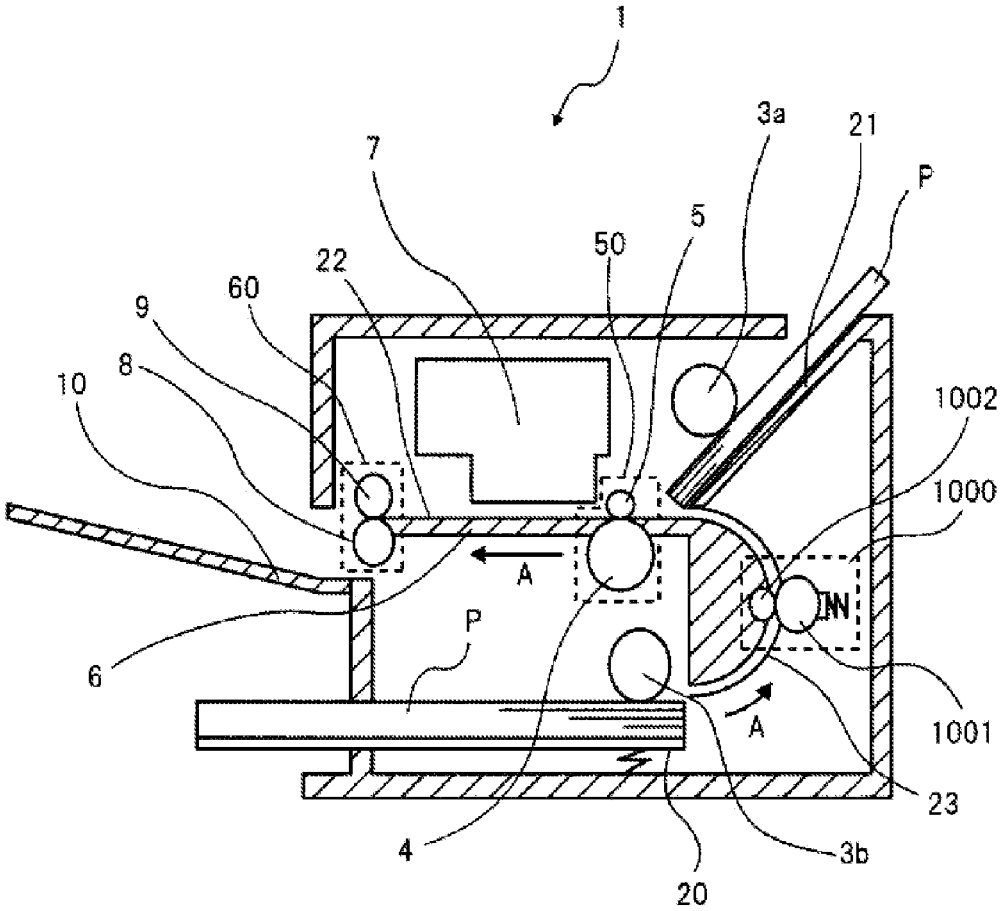
FIG. 1 is a sectional view showing the arrangement of the main part of a printing apparatus according to the first embodiment of the present invention.

FIG. 1 is a sectional view showing the arrangement of the main part of a printing apparatus according to this embodiment. A printing apparatus 1 shown in FIG. 1 is provided with feed trays 20 and 21. A plurality of printing media P (first printing media) are stacked and stored in the feed trays 20 and 21.

The printing media P stored in the feed tray 20 are fed one by one to a conveyance path 23 (another conveyance path) by a circular feeding roller 3*b* (second feeding roller). The feeding roller 3*b* is located near the rear end portion of the conveyance path 23. The conveyance path 23 is located behind a conveyance path 22 in a conveyance direction A. A liquid coating mechanism 1000 as a coating unit is placed on the conveyance path 23. The liquid coating mechanism 1000 coats the surface (printing surface) of the printing medium P passing through the conveyance path 23 with a liquid having a higher viscosity than water. The printing medium P (second printing medium) whose surface is coated with the liquid is transferred to a conveyance mechanism 50 (first conveyance mechanism). The conveyance mechanism 50 is provided on a rear end portion of the conveyance path 22 connected to the conveyance path 23. The conveyance mechanism 50 conveys the surface-treated printing medium P (second printing medium) in the conveyance direction A to feed the printing medium P to the conveyance path 23. A printing unit 7 is placed above the conveyance path 23. In this embodiment, the printing unit 7 is an inkjet printhead having an array of a predetermined number of ink discharge nozzles. The printing unit 7 performs printing operation of discharging ink from the nozzles onto the surface (printing surface) of the printing medium P in accordance with printing data while scanning in a direction perpendicular to the conveyance direction A. This apparatus forms an image on the printing medium P by alternately repeating this printing operation and the conveyance operation of the conveyance mechanism 50. A conveyance mechanism 60 (second conveyance mechanism) placed on the front end portion of the conveyance path 22 conveys the printing medium P, on which the image has been formed, out of the conveyance path 22 to discharge the printing medium to a printing medium discharge tray 10.

On the other hand, the printing media P stored in the feed tray 21 are fed one by one to the conveyance path 22 and transferred to the conveyance mechanism 50 by a circular feeding roller 3*a* (first feeding roller) placed near the rear end portion of the conveyance path 22. The contents of the subsequent operation are the same as those described above.

Note that the printing apparatus 1 may be a so-called a full-line type inkjet printing apparatus including a long inkjet printhead having nozzles arranged throughout the maximum width of the printing medium P.

Figure 2:
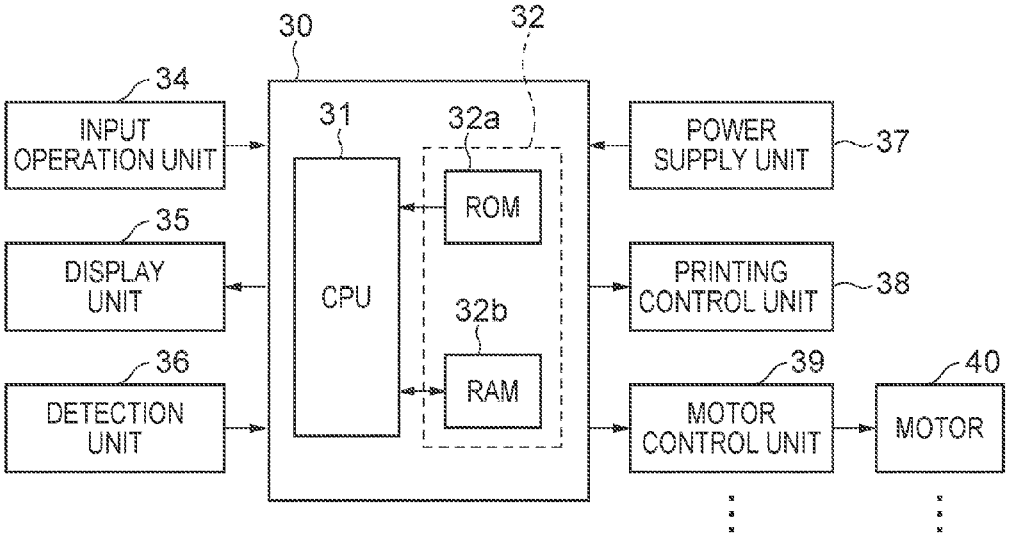
FIG. 2 is a block diagram showing the control arrangement of the printing apparatus shown in FIG. 1.

FIG. 2 is a block diagram showing the control arrangement of the printing apparatus 1. The printing apparatus 1 is provided with a control unit 30 including a CPU (Central Processing Unit) 31 and a storage unit 32. The CPU 31 executes processing operations such as various kinds of computation, control, and determination operations. The storage unit 32 includes a ROM (Read Only Memory) 32*a* and a RAM (Random Access Memory) 32*b*. The ROM 32*a* stores control programs executed by the CPU 31 and the like. The RAM 32*b* temporarily stores data during processing operation by the CPU 31, input data, and the like.

An input operation unit 34, a display unit 35, a detection unit 36, a power supply unit 37, a printing control unit 38, and a motor control unit 39 are connected to the control unit 30. The input operation unit 34 accepts the operation of inputting a predetermined command, data, or the like and outputs information indicating the contents of the operation to the control unit 30. The display unit 35 performs various kinds of display operations under the control of the control unit 30. The detection unit 36 detects the operation state and the like of each unit. The power supply unit 37 supplies power necessary to make each unit operate. The printing control unit 38 controls the operation of the printing unit 7. The motor control unit 39 controls the operation of a motor 40. Note that there are a plurality of motors 40 which are driving sources for the conveyance mechanisms 50 and 60 and the liquid coating mechanism 1000. The motor control units 39 are respectively connected to the motors 40.

Figure 3:
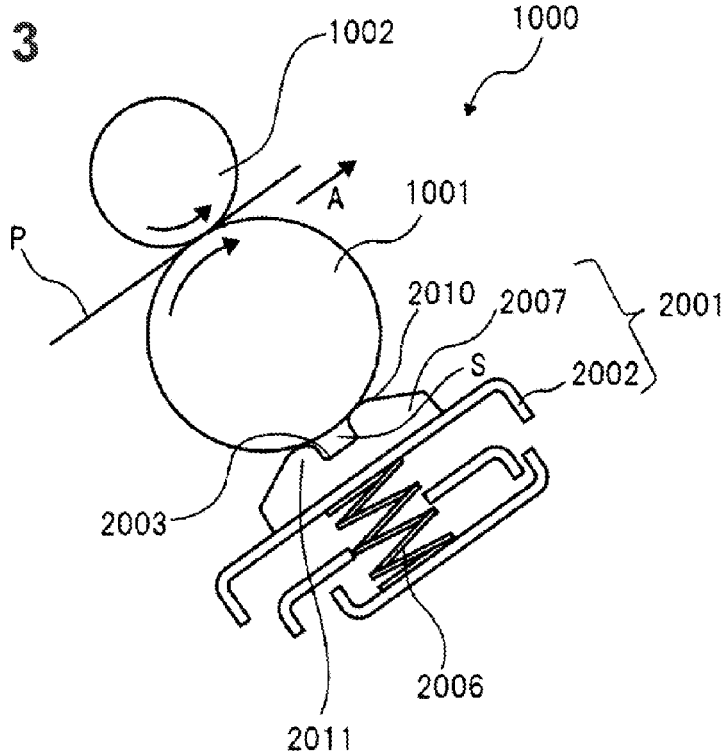
FIG. 3 is a sectional view showing the arrangement of a liquid coating mechanism provided in the printing apparatus shown in FIG. 1.

FIG. 3 is a sectional view showing the arrangement of the liquid coating mechanism provided in the printing apparatus 1. The liquid coating mechanism 1000 shown in FIG. 3 includes a cylindrical coating roller 1001, a cylindrical counter roller 1002 placed to face the coating roller 1001 and paired with the coating roller 1001, and a liquid supply member 2001 which supplies a liquid to the coating roller 1001.

The coating roller 1001 and the counter roller 1002 each have two ends pivotally mounted on a frame (not shown), and are pivotally supported by parallel shafts. The liquid supply member 2001 extends almost throughout the coating roller 1001 in the longitudinal direction. The liquid supply member 2001 are mounted on the above frame so as to be movable between an abutment position where the liquid supply member 2001 abuts against the outer surface of the coating roller 1001 and a distant position where the liquid supply member 2001 is spaced apart from the outer surface. When one of the motors 40 drives a cam, the liquid supply member 2001 moves between the abutment position and the distant position. Detecting the phase of the cam can acquire information indicating whether the coating unit has coated a printing medium with a liquid.

A spring member (not shown) urges the counter roller 1002 against the outer surface of the coating roller 1001. With this arrangement, when the coating roller 1001 rotates in the clockwise direction viewed from the sectional view of FIG. 3 while nipping the printing medium P together with the counter roller 1002, the counter roller 1002 rotates in the opposite direction. This conveys the printing medium P in the conveyance direction A.

Figure 4:
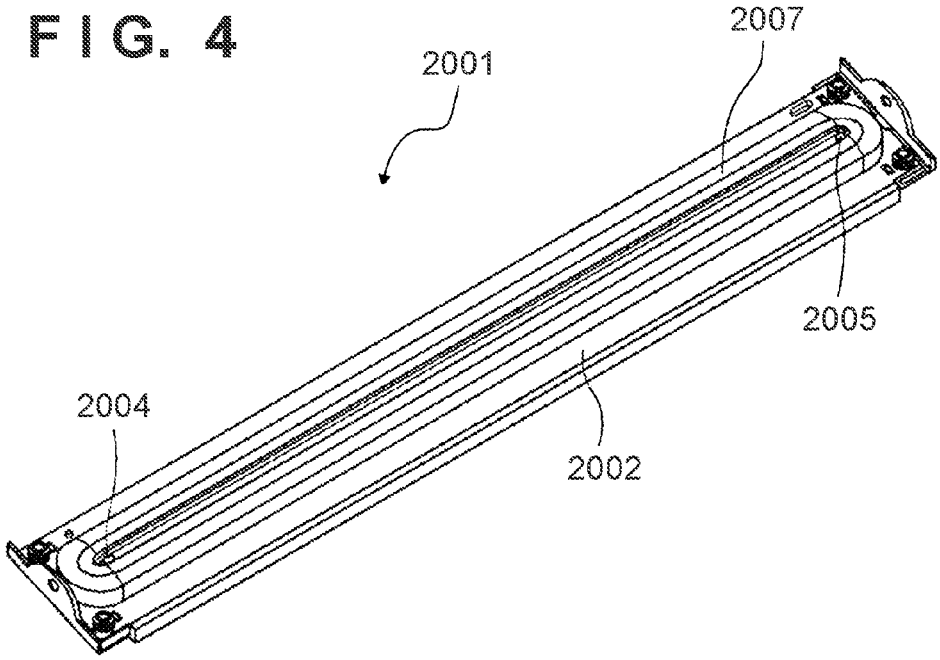
FIG. 4 is a perspective view showing the arrangement of a liquid supply member provided in the liquid coating mechanism shown in FIG. 3.

FIG. 4 is a perspective view showing the arrangement of the liquid supply member 2001. The arrangement of the liquid supply member 2001 will be described with reference to FIGS. 3 and 4.

The liquid supply member 2001 includes a cap plate 2002 and an abutment member 2007 integrally formed with the cap plate 2002. A recess portion 2003 extending in the longitudinal direction is formed in the middle portion of the abutment member 2007. An upper edge portion 2010 and a lower edge portion 2011 of the recess portion 2003 of the abutment member 2007 abut against the coating roller 1001 such that the abutment member 2007 can abut against the coating roller 1001 in conformity with its outer surface shape. The abutment member 2007, which is seamlessly and integrally formed in this manner, abuts against the outer surface of the coating roller 1001 continuously without any gap owing to the urging force of a spring member 2006. As a consequence, the liquid supply member 2001 and the outer surface of the coating roller 1001 form a substantially sealed space S, in which a liquid is held. When the coating roller 1001 is at rest, the abutment member 2007 is kept in tight contact with the outer surface of the coating roller 1001 to reliably prevent the liquid from leaking outside the space S. As will be described later, when the coating roller 1001 rotates, the liquid flows through between the outer surface of the coating roller 1001 and the abutment member 2007 and adheres to the outer surface of the coating roller in a laminar form. In this case, when the outer surface of the coating roller 1001 is in tight contact with the abutment member 2007 while the coating roller 1001 is at rest, this state prevents the liquid from flowing between the inside and outside of the space S, as described above. In this case, however, the tight contact state includes a state in which the abutment member 2007 is in direct contact with the outer surface of the coating roller 1001 and a state in which the abutment member 2007 abuts against the outer surface of the coating roller 1001 through a liquid film formed by capillary force.

In addition, the left and right side portions of the abutment member 2007 in the longitudinal direction gently curve when viewed from both the planar direction and the side direction. For this reason, even if the abutment member 2007 is made to abut against the coating roller 1001 with a relatively strong pressing force, the entire abutment member 2007 elastically deforms almost uniformly, and hence no large distortion appears locally. This allows the abutment member 2007 to abut against the outer surface of the coating roller 1001 continuously without any gap, thereby forming the substantially sealed space S described above. Note that the liquid supply member 2001 is configured to have a rotation center axis near the outer surface of the coating roller 1001, and is adjusted to the rotation center axis of the coating roller 1001.

As shown in FIG. 4, the cap plate 2002 is provided with a liquid supply port 2004 and a liquid recovery port 2005. The liquid supply port 2004 and the liquid recovery port 2005 both are holes extending through the cap plate 2002 in the area surrounded by the recess portion 2003 of the abutment member 2007. The liquid supply port 2004 and the liquid recovery port 2005 are connected to a liquid supply source (not shown). In this embodiment, the liquid supply port 2004 is formed near one end of the area surrounded by the recess portion 2003 of the abutment member 2007, and the liquid recovery port 2005 is formed near the other end of the area.

Note that the coating system used by the liquid coating mechanism 1000 according to this embodiment is a method of coating the entire surface of the printing medium P with a liquid by using the coating roller 1001 to transfer the liquid. However, the present invention may coat part of the surface of the printing medium P with a liquid. In addition, the present invention may use, as the liquid coating mechanism 1000, not only a mechanism based on the roller transfer system but also a liquid coating apparatus which processes the surface of the printing medium P by using a head including nozzles which spray a liquid.

In addition, the liquid used in this embodiment is a process liquid for quickening the coagulation of ink containing a pigment as a color material. The pigment as a color material in ink discharged to the printing medium P is made to react with this process liquid to quicken the coagulation of the pigment. This insolubilization can improve the print density. In addition, this can reduce or prevent bleeding. Note that in the present invention, the liquid coated on the surface of the printing medium P is not limited to the above process liquid. For example, it is possible to use a liquid containing a fluorescence whitener which improves the whiteness of a printing medium and has a higher viscosity than water. At this time, the arrangement of the printing unit 7 is not limited to an arrangement corresponding to the inkjet printing system, and may be an arrangement corresponding to a printing system such as the thermal transfer system or electrophotographic system.

Figure 5:
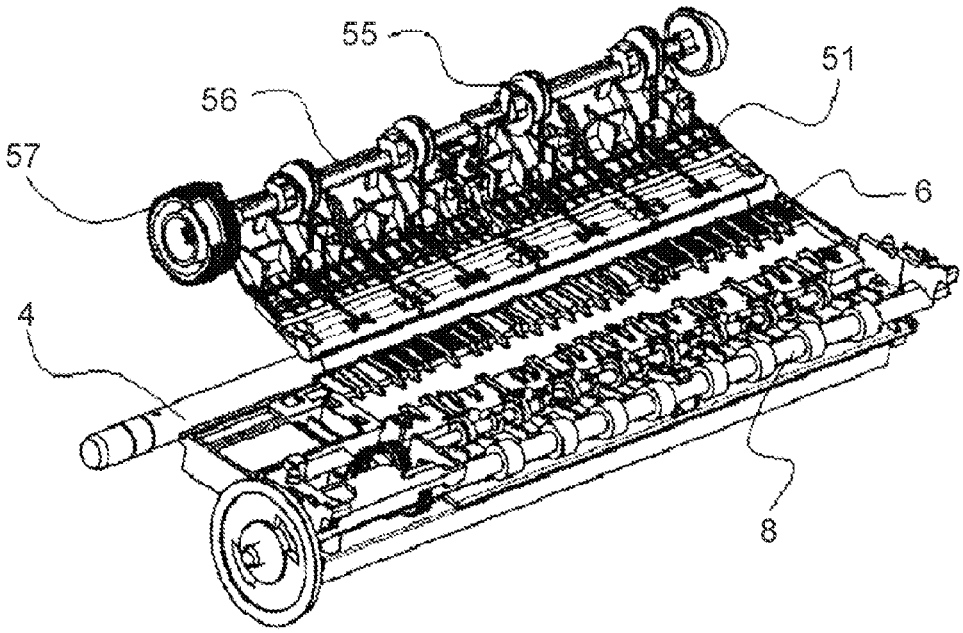
FIG. 5 is a perspective view showing the arrangement of a conveyance mechanism provided in the printing apparatus shown in FIG. 1.
Figure 6A:
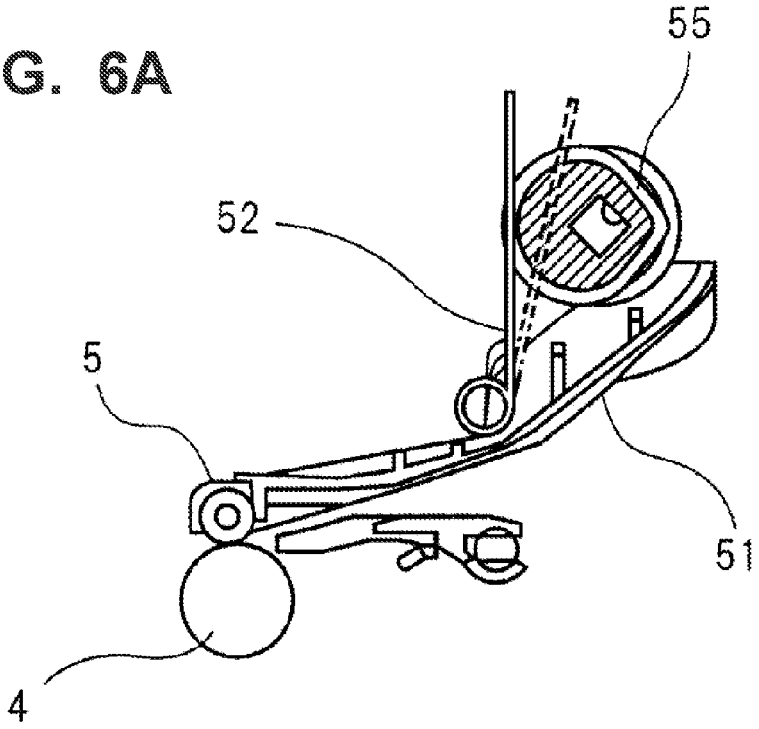
FIGS. 6A and 6B are sectional views showing the arrangement of the conveyance mechanism provided in the printing apparatus shown in FIG. 1.
Figure 6B:
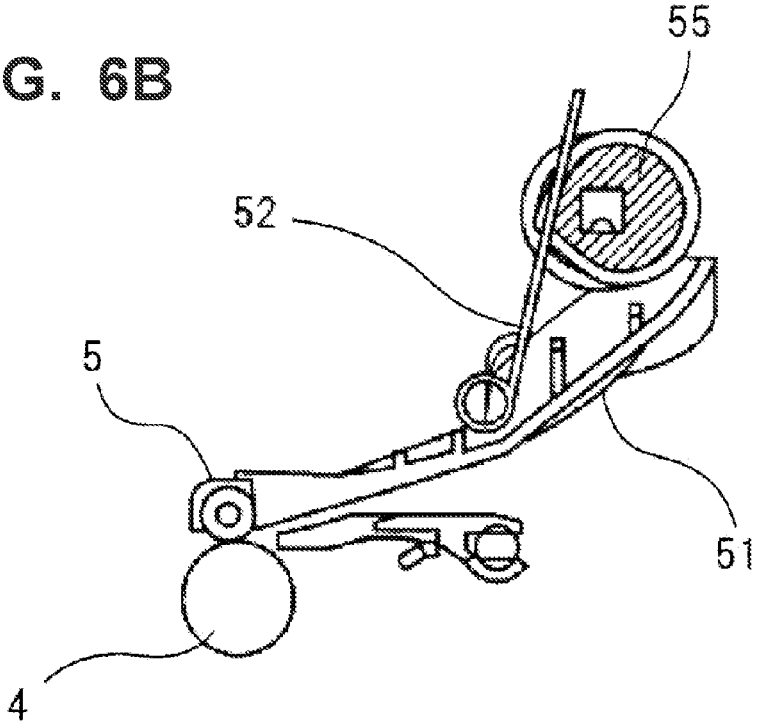

FIG. 5 is a perspective view showing the arrangement of the conveyance mechanism 50. FIGS. 6A and 6B are sectional views showing the arrangement of the conveyance mechanism 50. The printing medium P conveyed to the conveyance mechanism 50 is nipped between a conveyance roller 4 (main roller) and a pinch roller 5 (driven roller). A pinch roller holder 51, which holds the pinch roller 5, rotatably holds the pinch roller 5 and is pivotally mounted on a chassis (not shown).

In addition, the pinch roller 5 presses the conveyance roller 4 with the elastic force of a pinch roller spring 52 (elastic member) as a torsion coil spring. The pinch roller 5 rotates in a direction opposite to that of the conveyance roller 4 following the rotation of the conveyance roller 4, thus generating a conveyance force for the printing medium P.

A nipping force changing unit will be described next. A pinch roller cam 55 (rotation member) having an edge portion formed in a cam shape is connected to one end of the pinch roller spring 52. The pinch roller cam 55 is inserted in a pinch roller cam shaft 56 fixed to a frame (not shown). A pinch roller cam gear 57 to which power is transmitted from a driving source (motor 40) (not shown) is inserted in one end of the pinch roller cam shaft 56. When the pinch roller cam gear 57 rotates, the pinch roller cam 55 also rotates. When the pinch roller cam 55 rotates, the pinch roller spring 52 deforms in conformity with the cam shape of the pinch roller cam 55. With this operation, the elastic force of the pinch roller spring 52, that is, the pressing force with which the pinch roller 5 presses the conveyance roller 4 (the nipping force between the conveyance roller 4 and the pinch roller 5) changes in accordance with the rotational position of the pinch roller cam 55.

The pinch roller cam 55 can move between the first rotational position shown in FIG. 6A and the second rotational position shown in FIG. 6B. When the pinch roller cam 55 rotates in the direction indicated by the arrow in FIG. 6A, the pinch roller cam 55 is stationary (fixed) at the first rotational position since the pinch roller cam gear 57 is provided with a toothless portion. When the pinch roller cam 55 rotates in a direction opposite to the direction indicated by the arrow in FIG. 6A by a predetermined amount of rotation, the pinch roller cam 55 is stationary at the second rotational position shown in FIG. 6B. Note that it is possible to use a toothless portion to make the pinch roller cam 55 stationary at the second rotational position. This arrangement can switch between the rotational positions of the pinch roller cam 55 by using one driving source. The amount of deformation of the pinch roller spring 52 at the second rotational position is smaller than that at the first rotational position, and the pressing force with which the pinch roller 5 presses the conveyance roller 4 becomes smaller at the second rotational position.

In this embodiment, the elastic force (the pressing force of the pinch roller 5) of the pinch roller spring 52 corresponding to the first rotational position is 5.635 N (575 gf), and the elastic force of the pinch roller spring 52 corresponding to the second rotational position is 3.675 N (375 gf). The embodiment uses four pinch roller springs 52, and hence the total load exerted on the conveyance roller 4 is 22.54 N (2300 gf) at the first rotational position, and 14.7 N (1500 gf) at the second rotational position. In the embodiment, when the pinch roller cam 55 rotates from the second rotational position through 160°, the pinch roller cam 55 moves to the first rotational position.

When the pinch roller cam 55 is at rest at the first rotational position, the conveyance roller 4 and the pinch roller 5 nip a printing medium with the first nipping force. When the pinch roller cam 55 is at rest at the second rotational position, the conveyance roller 4 and the pinch roller 5 nip a printing medium with the second nipping force smaller than the first nipping force.

Conveyance control operation for the printing medium P which is executed by the printing apparatus 1 will be described next.

Figure 7:
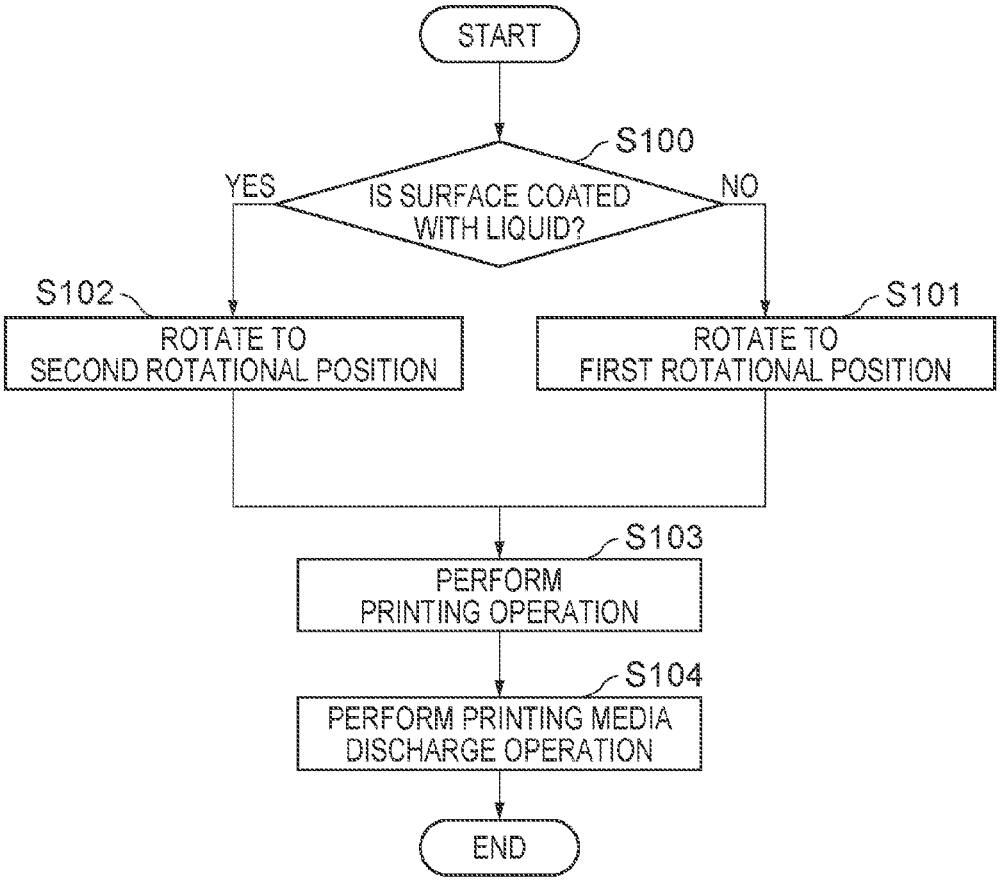
FIG. 7 is a flowchart showing a procedure for conveyance control operation executed by the printing apparatus shown in FIG. 1.

FIG. 7 is a flowchart showing a procedure for conveyance control operation executed by the printing apparatus according to this embodiment.

First of all, the input operation unit 34 accepts the operation of selecting whether to coat the surface of the printing medium P with a liquid, and outputs printing information indicating the selected printing medium to the control unit 30. The control unit 30 determines, based on the printing information, whether to coat the surface of the printing medium P with the liquid (S100).

When determining not to coat the surface of the printing medium P with the liquid, the control unit 30 rotates the feeding roller 3*a*. With this operation, the printing medium P is conveyed from the feed tray 21 to the conveyance mechanism 50. At this time, the control unit 30 rotates the pinch roller cam 55 to the first rotational position before the leading end of the printing medium P reaches the conveyance mechanism 50 (S101). Thereafter, the printing medium P is conveyed to the conveyance path 22 with the pressing force (first nipping force) of the pinch roller 5 corresponding to the first rotational position. On the conveyance path 22, the printing unit 7 performs printing operation (S103). Upon completion of the printing operation, the conveyance mechanism 60 conveys the printing medium P from the conveyance path 22 to the printing medium discharge tray 10 (S104). In the conveyance mechanism 60, the printing medium P is nipped between a printing medium discharge roller 8 and a printing medium discharge spur 9 and is discharged to the printing medium discharge tray 10 by the rotation of the printing medium discharge roller 8.

When determining to coat the surface of the printing medium P with the liquid, the control unit 30 rotates the feeding roller 3*b*. With this operation, the printing medium P is fed from the feed tray 20 to the conveyance path 23. Thereafter, on the conveyance path 23, the liquid coating mechanism 1000 coats the surface of the printing medium P with the liquid. The printing medium P coated with the liquid is conveyed to the conveyance mechanism 50. At this time, the control unit 30 rotates the pinch roller cam 55 to the second rotational position before the leading end of the printing medium P reaches the conveyance mechanism 50 (S102). The printing medium P is then conveyed to the conveyance path 22 with the pressing force (the second nipping force smaller than the first nipping force) of the pinch roller 5 corresponding to the second rotational position. On the conveyance path 22, the printing unit 7 performs printing operation (S103). Upon completion of the printing operation, the conveyance mechanism 60 conveys the printing medium P from the conveyance path 22 to the printing medium discharge tray 10 (S104).

In this embodiment, as described above, when the conveyance mechanism 50 conveys the printing medium P whose surface is coated with the liquid, the pressing force of the pinch roller 5 automatically decreases. For this reason, even if a foreign substance (a mixture of the liquid and paper dust) is generated on the surface of the printing medium P, the foreign substance does not easily adhere to the pinch roller 5 and the conveyance roller 4. This makes it possible to reduce foreign substances adhering to the conveyance mechanism 50 even without conveying a special sheet. It is therefore possible to easily reduce foreign substances adhering to the conveyance mechanism 50.

In this embodiment, the conveyance mechanism 50 is provided with the pinch roller spring 52 and the pinch roller cam 55. However, the printing medium discharge roller 8 and the printing medium discharge spur 9 suffer from the same problem as described above in terms of the deposition of foreign substances due to the conveyance of the printing medium P whose surface is coated with a special liquid. It is therefore possible to apply the pinch roller spring 52 and the pinch roller cam 55 to the conveyance mechanism 60. This makes it possible to change the pressing force of the printing medium discharge spur 9 simultaneously with pivoting of the pinch roller cam 55. Performing this operation in response to the operation of the pinch roller 5 can suppress the deposition of foreign substances on the conveyance roller 4 and the printing medium discharge roller 8. At this time, the pressing force of the pinch roller 5 may be smaller than that of the printing medium discharge spur 9. This is because, since the printing medium discharge roller 8 is placed downstream in the conveyance direction A of the printing medium P relative to the conveyance roller 4, the printing medium P is conveyed to the printing medium discharge roller 8 after the lapse of a long period of time since the medium was coated with the liquid as compared with the conveyance roller 4. That is, this is because foreign substances do not easily adhere to the printing medium discharge roller 8 as compared with the conveyance roller 4.

In addition, in order to inhibit foreign substances generated on the surface of the printing medium P from adhering to the surface of the pinch roller 5, it is possible to decrease the pressing force of the pinch roller 5 only when the printing medium P is nipped between the conveyance roller 4 and the pinch roller 5. More specifically, the control unit 30 may fix the pinch roller cam 55 at the second rotational position until the printing medium P whose surface is coated with the liquid is conveyed out of the conveyance path 22.

Furthermore, in order to inhibit a mixture of paper dust and the liquid which adheres to the surface of the pinch roller 5 from being pressed and hardened by the conveyance roller 4, it is possible to decrease the pressing force of the pinch roller 5 when the printing medium P is not nipped between the conveyance roller 4 and the pinch roller 5. For example, it is possible to decrease the pressing force of the pinch roller 5 when the conveyance roller 4 and the pinch roller 5 idly rotate upon interlocking with another mechanism or after the printing medium P whose surface is not coated with the liquid is conveyed out of the conveyance path 22.

Second Embodiment

Figure 8:
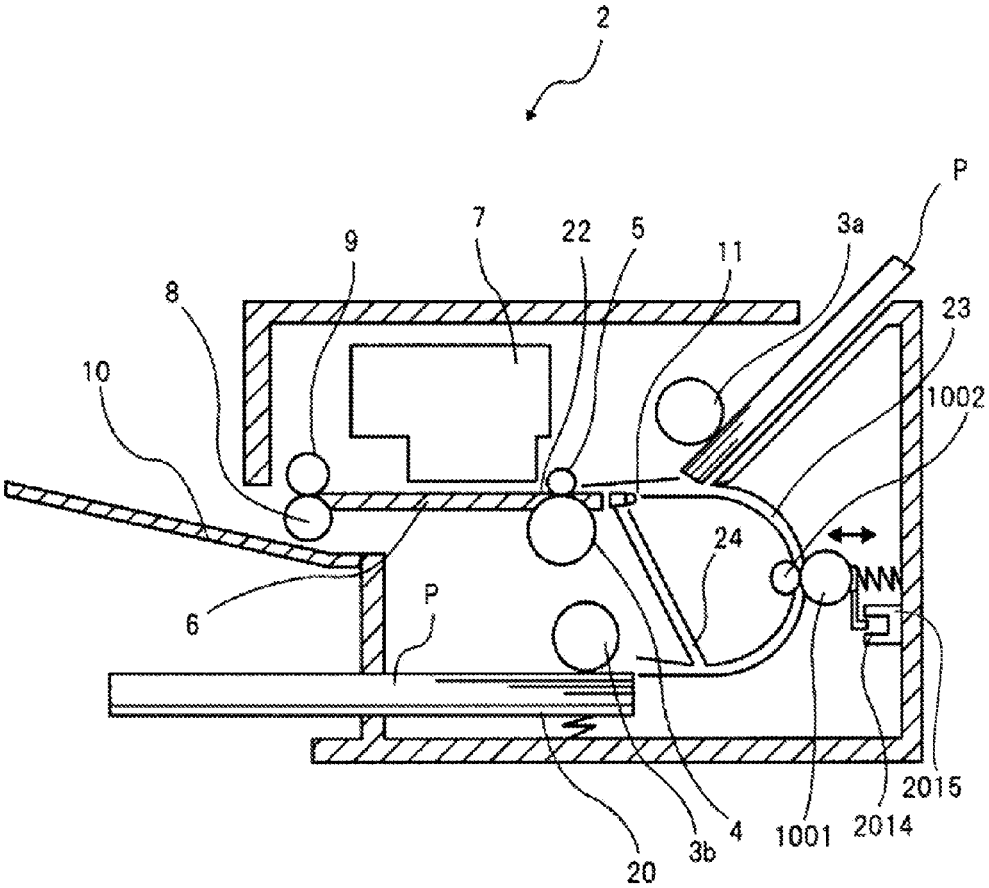
FIG. 8 is a sectional view showing the arrangement of the main part of a printing apparatus according to the second embodiment of the present invention.

FIG. 8 is a sectional view showing the arrangement of the main part of a printing apparatus according to this embodiment. The same reference numerals as those of the constituent elements of the printing apparatus 1 shown in FIG. 1 denote the same constituent elements of a printing apparatus 2 shown in FIG. 8, and detailed description of them will be omitted.

In the printing apparatus 2, when a liquid supply member 2001 moves from an abutment position to a distant position, a pump (not shown) performs liquid recovery operation. When the liquid supply member 2001 moves from the distant position to the abutment position, the pump performs liquid supply operation. The printing apparatus 2 is provided with a detection lever 2014 for detecting whether the liquid supply member 2001 abuts against or is separated from a coating roller 1001. When the liquid supply member 2001 abuts against the coating roller 1001, the detection lever 2014 shuts the transmission of an optical signal in a position sensor 2015. This makes it possible to detect whether the liquid supply member 2001 abuts against or is separated from the coating roller 1001. The detection lever 2014 and the position sensor 2015 constitute an acquisition unit which acquires information indicating whether a coating unit has coated a printing medium with a liquid.

The liquid supply member 2001 supplies a liquid to the coating roller 1001 while the liquid supply member 2001 abuts against the coating roller 1001. Subsequently, when the coating roller 1001 rotates in the clockwise direction viewed from the sectional view of FIG. 8, the coating roller 1001 coats the surface of a printing medium P with the liquid while conveying the printing medium P.

When the printing medium P is fed to a conveyance path 23 while the liquid supply member 2001 is separated from the coating roller 1001, the coating roller 1001 functions as a conveyance roller without performing liquid coating operation.

In the printing apparatus 2, the connecting portion between a conveyance path 22 and the conveyance path 23 is provided with a conveyance path switching member 11 which pivots to guide the printing medium P to a conveyance path 24. Upon completion of printing operation by a printing unit 7, this apparatus reversely rotates the respective rollers while nipping the printing medium P between a printing medium discharge roller 8 and a printing medium discharge spur 9, and simultaneously makes the conveyance path switching member 11 pivot, thereby guiding the printing medium P to the conveyance path 24. After the trailing end of the printing medium P passes through a conveyance roller 4, the apparatus stops the printing medium discharge roller 8 and the conveyance roller 4 or switches them to forward rotation. The apparatus then starts forward rotation before at least the leading end of the printing medium P reaches the conveyance roller 4 again. The printing medium P guided to the conveyance path 24 enters the conveyance path 23 and passes between the coating roller 1001 and the liquid supply member 2001. At this time, moving the liquid supply member 2001 to an abutment position or a distant position with respect to the coating roller 1001 can select whether to coat the printing medium P with a liquid. This allows to select whether to coat the two surfaces of the printing medium P with the liquid. After passing through the coating roller 1001, the printing medium P is transferred to the conveyance roller 4 again, and the printing unit 7 performs printing operation. This allows the printing apparatus 2 to print on the reverse surface of the printing medium P without making the user touch the printing medium P.

In order to cope with a change in the feed amount of the conveyance roller 4 in accordance with the rigidity of the printing medium P, the printing apparatus 2 corrects the rotation amount of the conveyance roller 4 in accordance with the rigidity of the printing medium P. More specifically, this apparatus stores, in a ROM 32*a*, correction data indicating the correspondence between the rotation amount of the conveyance roller 4 and each printing medium, and makes a control unit 30 rotate the conveyance roller 4 by the rotation amount indicated by correction data made to correspond to the printing medium selected with an input operation unit 34.

The printing apparatus 2 makes the control unit 30 rotate a pinch roller cam 55 to the second rotational position (see FIG. 6B) when the liquid supply member 2001 moves to the abutment position. When the liquid supply member 2001 moves to the distant position, the control unit 30 rotates the pinch roller cam 55 to the first rotational position (see FIG. 6A). The printing apparatus allows the user to select, with the input operation unit 34, a printing medium (third printing medium) which has a higher rigidity than the printing medium P and whose surface is coated with a liquid. When the user selects this printing medium, the control unit 30 rotates the pinch roller cam 55 to the third rotational position. The pressing force of a pinch roller 5 corresponding to the third rotational position is smaller than that corresponding to the first rotational position and larger than that corresponding to the second rotational position.

Figure 9:
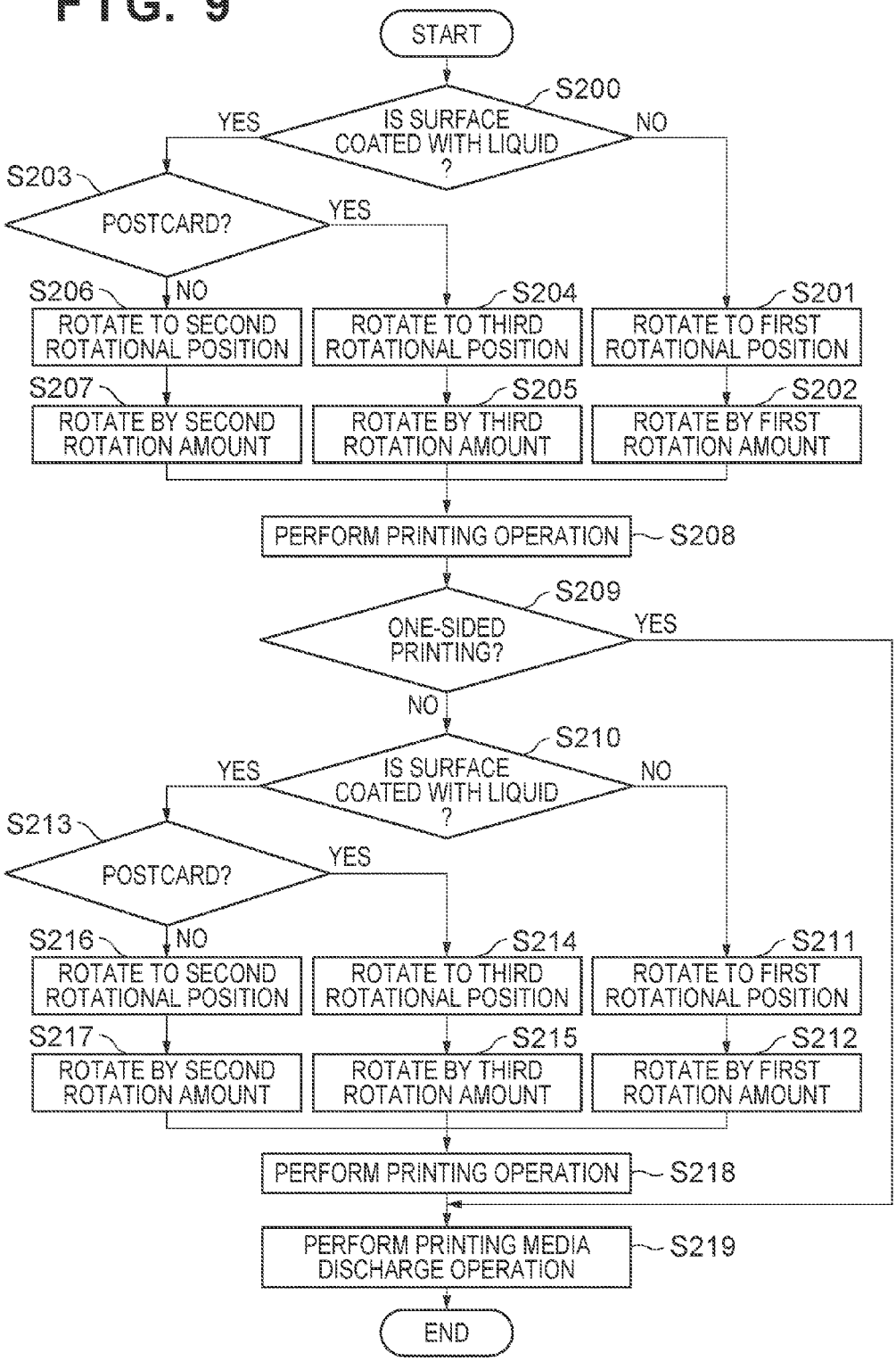
FIG. 9 is a flowchart showing a procedure for conveyance control operation executed by the printing apparatus shown in FIG. 8.

FIG. 9 is a flowchart showing a procedure for conveyance control operation executed by the printing apparatus according to this embodiment.

First of all, upon accepting the operation of selecting the type of printing medium P, whether to coat the printing medium with a liquid, and a printing surface, the input operation unit 34 outputs printing information indicating the contents of the selection to the control unit 30. Based on the printing information, the control unit 30 determines whether to coat the surface of the printing medium P with a liquid (S200). Assume that in this embodiment, the user can select plain paper or a postcard having higher rigidity than plain paper as the type of printing medium P. Assume also that the user can select the obverse surface (one surface) or two surfaces of the printing medium P as a printing surface or printing surfaces.

When coating the surface of the printing medium P with a liquid, the control unit 30 moves the liquid supply member 2001 to the abutment position and coats the outer surface of the coating roller 1001 with a liquid. When not coating the surface of the printing medium P with a liquid, the control unit 30 performs liquid recovery operation, and moves the liquid supply member 2001 to the distant position. The control unit 30 then determines the rotational position of the pinch roller cam 55 in accordance with the detection result obtained by the detection lever 2014.

If the detection result obtained by the position sensor 2015 indicates the distant position, the control unit 30 rotates the pinch roller cam 55 to the first rotational position before the printing medium P reaches a conveyance mechanism 50 (S201). If the detection result obtained by the position sensor 2015 indicates the abutment position, the control unit 30 determines, based on the above printing information, whether the printing medium P is a postcard (S203).

If the printing medium P is a postcard, the control unit 30 rotates the pinch roller cam 55 to the third rotational position before the printing medium P reaches the conveyance mechanism 50 (S204). If the printing medium P is not a postcard but is plain paper, the control unit 30 rotates the pinch roller cam 55 to the second rotational position before the printing medium P reaches the conveyance mechanism 50 (S206).

In this embodiment, the elastic force of the pinch roller spring 52 (the pressing force of the pinch roller 5) corresponding to the first rotational position is 5.635 N (575 gf). The elastic force of the pinch roller spring 52 corresponding to the second rotational position is 3.675 N (375 fg). The elastic force of the pinch roller spring 52 corresponding to the third rotational position is 4.655 N (475 gf).

After the rotational position of the pinch roller cam 55 is determined by the operation in steps S201, S204, and S206, the control unit 30 feeds the printing medium P to the conveyance path 22 with the rotation amount of the conveyance roller 4 based on the above correction data. More specifically, when not coating the surface of the printing medium P with a liquid, the control unit 30 rotates the conveyance roller 4 by the first rotation amount indicated by correction data (S202). When coating the surface of the printing medium P with a liquid and the printing medium P is a postcard, the control unit 30 rotates the conveyance roller 4 by the second rotation amount indicated by correction data (S205). When coating the surface of the printing medium P with a liquid and the printing medium P is plain paper, the control unit 30 rotates the conveyance roller 4 by the third rotation amount indicated by correction data (S207). After the conveyance roller 4 rotates in this manner, the printing unit 7 prints on the surface of the printing medium P (S208).

Upon completion of the printing operation on the surface of the printing medium P, the control unit 30 determines, based on the above printing information, whether to perform one-sided printing (S209). When performing one-sided printing, the control unit 30 causes the printing medium discharge roller 8 to discharge the printing medium P to a printing medium discharge tray 10 (S219). When performing two-sided printing instead of one-sided printing, the control unit 30 determines from the above printing information whether to coat the reverse surface of the printing medium P (S210). The control unit 30 moves the liquid supply member 2001 to the abutment position or the distant position in accordance with this determination result. At this time, when coating the two surfaces of the printing medium P with the liquid or coating neither of the two surfaces of the printing medium P with the liquid, the control unit 30 does not move the liquid supply member 2001.

If the detection result obtained by the position sensor 2015 indicates the distant position, the control unit 30 rotates the pinch roller cam 55 to the first rotational position before the printing medium P reaches the conveyance mechanism 50 through the conveyance paths 24 and 23 (S211). If the detection result obtained by the position sensor 2015 indicates the abutment position, the control unit 30 determines, based on the above printing information, whether the printing medium P is a postcard (S213).

If the printing medium P is a postcard, the control unit 30 rotates the pinch roller cam 55 to the third rotational position before the printing medium P reaches the conveyance mechanism 50 through the conveyance paths 24 and 23 (S214). If the printing medium P is plain paper, the control unit 30 rotates the pinch roller cam 55 to the second rotational position before the printing medium P reaches the conveyance mechanism 50 through the conveyance paths 24 and 23 (S216).

After the rotational position of the pinch roller cam 55 is determined by the operation in steps S211, S214, and S216, the control unit 30 feeds the printing medium P to the conveyance path 22 by the rotation amount of the conveyance roller 4 based on the above correction data. More specifically, when not coating the reverse surface of the printing medium P with a liquid, the control unit 30 rotates the conveyance roller 4 by the first rotation amount indicated by the correction data (S212). When coating the reverse surface of the printing medium P with a liquid and the printing medium P is a postcard, the control unit 30 rotates the conveyance roller 4 by the second rotation amount indicated by the correction data (S215). When coating the reverse surface of the printing medium P with a liquid, and the printing medium P is plain paper, the control unit 30 rotates the conveyance roller 4 by the third rotation amount indicated by the correction data (S217). In this manner, after the conveyance roller 4 rotates, the printing unit 7 prints on the reverse surface of the printing medium P (S218).

Upon completion of the printing operation on the reverse surface of the printing medium P, the control unit 30 causes the printing medium discharge roller 8 to discharge the printing medium P to the printing medium discharge tray 10 (S219).

Like the printing apparatus 1 described in the first embodiment, the printing apparatus 2 in this embodiment automatically reduces the pressing force of the pinch roller 5 when the conveyance mechanism 50 conveys the printing medium P whose surface is coated with a liquid. Even if, therefore, a foreign substance (a mixture of the liquid and paper dust) is generated on the surface of the printing medium P, the foreign substance does not easily adhere to the pinch roller 5 and the conveyance roller 4. This makes it possible to reduce foreign substances adhering to the conveyance mechanism 50 without conveying a special sheet. It is therefore possible to easily reduce foreign substances adhering to the conveyance mechanism 50.

In addition, the printing apparatus 2 of this embodiment makes the control unit 30 selectively change the rotational position of the pinch roller cam 55 and the conveyance amount of the conveyance roller 4. This makes it possible to selectively correct the rotation amount of the conveyance roller 4 in accordance with each rotational position of the pinch roller cam 55.

Note that it is possible to provide another conveyance path which allows the printing medium P to reach the conveyance mechanism 50 from the conveyance path 24 without through the conveyance path 23. In this case, when not coating the reverse surface of the printing medium P with a liquid, the apparatus can reliably prevent the printing medium P from being erroneously coated with the liquid by making the printing medium P pass through another conveyance path (not making the printing medium P pass through the conveyance path 23).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-278207 filed on Dec. 14, 2010, which is hereby incorporated by reference herein in its entirety.

What is claimed is:

1. A conveyance apparatus, comprising:

an input operation unit configured to perform an operation of selecting, as a printing medium, a first printing medium or a second printing medium, obtained by coating a surface of a printing medium with a liquid having a higher viscosity than water, and output information indicating the selected printing medium;

a conveyance path through which the selected printing medium passes;

a conveyance mechanism provided on said conveyance path and configured to convey the selected printing medium in a conveyance direction; and a control unit connected to said input operation unit and said conveyance mechanism, wherein said conveyance mechanism includes:

a main roller, a driven roller which presses said main roller through the selected printing medium and rotates in a direction opposite to a rotating direction of said main roller upon rotation of said main roller, a rotation member having a cam shape, and an elastic member which deforms in conformity with the cam shape at the time of rotation of said rotation member to change a pressing force to press said driven roller against said main roller in accordance with a rotational position of said rotation member, and wherein said control unit rotates said rotation member to a first rotational position when the selected printing medium indicated by the information is the first printing medium, and rotates said rotation member to a second rotational position where the pressing force becomes smaller than the pressing force at the first rotational position when the selected printing medium indicated by the information is the second printing medium.

2. The apparatus according to claim 1, wherein said conveyance mechanism is provided on one of a rear end portion and a front end portion of said conveyance path in the conveyance direction.

3. The apparatus according to claim 1, wherein said conveyance mechanism comprises:

a first conveyance mechanism provided on a rear end portion of said conveyance path in the conveyance direction, and a second conveyance mechanism provided on a front end portion of said conveyance path in the conveyance direction, and wherein the pressing force corresponding to the second rotational position in said first conveyance mechanism is smaller than the pressing force corresponding to the second rotational position in said second conveyance mechanism.

4. The apparatus according to claim 1, wherein when the selected printing medium is the second printing medium, said control unit fixes said rotation member at the second rotational position until the second printing medium is conveyed out of said conveyance path.

5. The apparatus according to claim 1, wherein when the selected printing medium is the first printing medium, said control unit rotates said rotation member from the first rotational position to the second rotational position after the first printing medium is conveyed out of said conveyance path.

6. The apparatus according to claim 1, further comprising:

a liquid coating mechanism placed behind said conveyance mechanism in the conveyance direction and configured to coat a surface of the first printing medium with the liquid when the second printing medium is selected with said input operation unit.

7. The apparatus according to claim 6, further comprising:

a first feeding roller placed near a rear end portion of said conveyance path in the conveyance direction and configured to rotate to feed the first printing medium to said conveyance path, another conveyance path which is connected to the rear end portion of said conveyance path and on which said liquid coating mechanism is placed, and a second feeding roller placed near a rear end portion of the other conveyance path in the conveyance direction and configured to rotate to feed the first printing medium to the other conveyance path, wherein said control unit rotates the first feeding roller when the selected printing medium is the first printing medium, and rotates the second feeding roller when the selected printing medium is the second printing medium.

8. The apparatus according to claim 6, wherein said liquid coating mechanism comprises:

a pair of rollers configured to rotate in opposite directions while nipping the selected printing medium to convey the selected printing medium to said conveyance path, and a liquid supply member configured to move between an abutment position where said liquid supply member abuts against an outer surface of one of said pair of rollers and a distant position where said liquid supply member is separated from the outer surface and coat the outer surface with the liquid when said liquid supply member is located at the abutment position, and said control unit moves said liquid supply member to the distant position when the selected printing medium is the first printing medium, and moves said liquid supply member to the abutment position when the selected printing medium is the second printing medium.

9. The apparatus according to claim 1, wherein said input operation unit accepts the operation of selecting, as the printing medium, one of the first printing medium, the second printing medium, and a third printing medium which has a higher rigidity than the first printing medium and whose surface is coated with the liquid, and when the selected printing medium is the third printing medium, said control unit rotates said rotation member to a third rotational position where the pressing force is smaller than the pressing force at the first rotational position and larger than the pressing force at the second rotational position.

10. The apparatus according to claim 1, further comprising:

a storage unit configured to store correction data indicating a rotation amount of said main roller in correspondence with each printing medium, wherein said control unit rotates said main roller by a rotation amount indicated by the correction data in correspondence with a printing medium selected as the selected printing medium.

11. A printing apparatus comprising:

a conveyance apparatus according to claim 1; and a printing unit placed above said conveyance path in said conveyance apparatus and configured to print on the selected printing medium.

12. The apparatus according to claim 11, wherein said printing unit is an inkjet printhead configured to discharge ink to the selected printing medium.

13. A printing medium conveyance apparatus comprising:

a coating unit configured to selectively coat a printing medium with a liquid;

a conveyance roller configured to convey the printing medium downstream of said coating unit in a conveyance direction;

a driven roller configured to nip the printing medium in cooperation with said conveyance roller by a nipping force;

a nipping force changing unit configured to change the nipping force by said conveyance roller and said driven roller;

an acquisition unit configured to acquire information indicating whether said coating unit has coated the printing medium with a liquid; and a control unit configured to control said nipping force changing unit in accordance with information acquired by said acquisition unit to change a nipping force as needed such that when a printing medium coated with no liquid is conveyed, the printing medium is nipped with a first nipping force, and when a printing medium coated with a liquid is conveyed, the printing medium is nipped with a second nipping force smaller than the first nipping force.

14. A printing medium conveyance apparatus comprising:

a coating unit configured to selectively coat a printing medium with liquid;

a conveyance roller located downstream of said coating unit in a conveyance direction and configured to convey the printing medium;

a driven roller configured to nip the printing medium in cooperation with said conveyance roller by a nipping force;

a changing unit configured to change the nipping force; and a control unit configured to control said changing unit such that the printing medium is nipped with a first nipping force when a printing medium not coated with liquid is conveyed, and the printing medium is nipped with a second nipping force smaller than the first nipping force when a printing medium coated with liquid is conveyed.

15. The apparatus according to claim 14, further comprising:

a storage unit configured to store correction data indicating a rotation amount of said conveyance roller in correspondence with each printing medium, wherein said control unit rotates said conveyance roller by a rotation amount indicated by the correction data in correspondence with a printing medium selected as the selected printing medium.

* * * * *